United States Patent [19]

Hosoyama et al.

[11] Patent Number: 4,498,313

[45] Date of Patent: Feb. 12, 1985

[54] COMPACT HELIUM GAS-REFRIGERATING AND LIQUEFYING APPARATUS

[75] Inventors: Kenji Hosoyama, Ibaragi; Hiromi Hirabayashi, Tsuchiura, both of Japan

[73] Assignee: National Laboratory for High Energy Physics, Ibaragi, Japan

[21] Appl. No.: 565,606

[22] Filed: Dec. 27, 1983

[30] Foreign Application Priority Data

Dec. 27, 1982 [JP] Japan ..... 57-233113

[51] Int. Cl.[3] ..... F25D 9/00

[52] U.S. Cl. ..... 62/514 R; 62/402

[58] Field of Search ..... 62/514 R, 402

[56] References Cited

U.S. PATENT DOCUMENTS 3,611,740 10/1971 Giger ..... 62/514 R 3,613,387 10/1971 Collins ..... 62/514 R 4,189,930 2/1980 Davydov et al. ..... 62/514 R 4,346,563 8/1982 Hood ..... 62/514 R

*Primary Examiner*—Ronald C. Capossela

*Attorney, Agent, or Firm*—Parkhurst & Oliff

[57] ABSTRACT

A compact helium gas-refrigerating and liquefying apparatus with excellent properties and high reliability is provided. The apparatus comprises: a neon gas-refrigerating and liquefying circuit system which precools helium gas and comprises a turbo type compressor, heat exchangers, turbo type expansion machines and a Joule-Thomson valve; and a helium gas-refrigerating and liquefying circuit system which receives the precooled helium gas and comprises a turbo type compressor, heat exchangers, an expansion turbine and a Joule-Thomson valve; the former circuit system being constructed to associate with the latter circuit system so as to further cool the precooled helium gas in the latter circuit system by heat exchange therewith.

7 Claims, 2 Drawing Figures

COMPACT HELIUM GAS-REFRIGERATING AND LIQUEFYING APPARATUS

BACKGROUND OF THE INVENTION

The present invention relates to a helium gas-refrigerating and liquefying apparatus which will be abbreviated occasionally as "apparatus" hereinafter.

Recently, accompanying the development of superconductivity technology, demand for liquid helium has increased rapidly. A helium gas-refrigerating and liquefying apparatus which produces liquid helium is, usually, composed of a compressor, heat exchangers and an expansion machine. In order to improve reliability and efficiency of such apparatus of large size, many researches and developments have been made, especially in regard to heat exchangers and expansion machines. As a result, many technical problems of heat exchangers and expansion machines have been solved. However, large size compressors have not been developed sufficiently and still have technical problems.

A prior art apparatus for generating cold of a temperature range of 1.8°–20° K. is shown in the attached FIG. 1. When using the apparatus, helium gas is compressed by a helium compressor 1 to a high pressure of about 10–15 atm, and the high pressure helium gas is transported to a heat exchanger 2 wherein it is heat exchanged with low temperature return helium gas coming from an expansion turbine 5 through a heat exchanger 3 and from a Joule-Thomson valve 6 through heat exchangers 4 and 3 thereby to decrease its temperature. A portion of the helium gas exited from the heat exchanger 2 is distributed to the expansion turbine 5 to do work therein and decrease its temperature to become a portion of the aforementioned low temperature return helium gas. The rest of the high pressure helium gas from the heat exchanger 2 is passed through heat exchangers 3 and 4 to further decrease its temperature, and subsequently transported to the Joule-Thomson valve 6 wherein it is adiabatically freely expanded to further decrease its temperature. As a result of the adiabatic free expansion and decrease of temperature, a portion of the helium gas is liquefied in the Joule-Thomson valve 6, which is in turn transported as a charge to a superconducting magnet or the like device 7 to cool the same.

In the aforementioned helium compressor, heretofore use has been made of a piston type compressor or a screw type compressor. However, piston type compressors have low reliability over a long period of operation, though they have good properties such as high isothermal efficiency. In contrast, screw type compressors have low isothermal efficiency, through they have good reliability over a long period of operation. In addition, both the piston type compressors and the screw type compressors have a drawback that their sizes become unavoidably large.

Instead of using a piston type compressor or a screw type compressor, adoption of a turbo type compressor having superior characteristics from the view points of size, reliability and properties as compared with the piston type compressors and the screw type compressors could be considered for rapidly improving the reliability and the properties of the large size apparatus and for minimizing the size thereof. However, helium gas has a low molecular weight of 4 and a high mean molecular velocity at an ambient temperature, so that it can not be compressed efficiently to a high pressure of, e.g., about 10 atm in a turbo type compressor. Therefore, hitherto, a helium gas-refrigerating and liquefying apparatus using a high pressure turbo type compressor was not practiced as far as the inventors know.

SUMMARY OF THE INVENTION

It is accordingly an object of the present invention to provide a helium gas-refrigerating and liquefying apparatus with excellent properties and high reliability over a long period of operation.

Another object of the present invention is to provide a compact helium gas-refrigerating and liquefying apparatus with excellent properties and high reliability over a long period of operation which can compress helium gas of an ambient temperature efficiently.

In order to achieve the above objects, the inventors have made many efforts in researches and experiments leading to a finding that the drawbacks of the conventional apparatus can be obviated by providing a neon gas-refrigerating and liquefying circuit system which precools helium gas to a temperature of about 25°–30° K. by the use of cold neon gas which has a large molecular weight of 20, rather, than the low molecular weight of 4 of helium, and which can be compressed efficiently at an ambient temperature by a turbo type compressor, precooling helium gas to a temperature area of about 25°–30° K. to sufficiently decrease its mean molecular velocity and subsequently compressing the precooled helium gas efficiently by a turbo type compressor in the apparatus.

In refrigerating and liquefying helium gas by using a turbo type compressor, it is important in designing the strength of the turbo type compressor to decrease the temperature of helium gas to be compressed to about 25°–30° K.

Therefore, the helium gas-refrigerating and liquefying apparatus of the present invention, comprises a neon gas-refrigerating and liquefying circuit system (hereinafter, abridged as "neon circuit system") which precools helium gas and comprises a turbo type compressor, heat exchangers, turbo type expansion machines and a Joule-Thomson valve with an optional liquid neon storage tank; and a helium gas-refrigerating and liquefying circuit system (hereinafter, abridged as "helium circuit system") which receives the precooled helium gas and comprises a turbo type compressor, heat exchangers, and expansion turbine and a Joule-Thomson valve with an optional liquid helium storage tank; the neon circuit system being constructed to associate with the helium circuit system so as to further cool the precooled helium gas in the helium circuit system by heat exchange therewith.

By this arrangement, the whole apparatus can be fully turbonized, so that a compact apparatus with a large capacity and excellent properties can be provided.

In one embodiment of the present invention, the neon circuit system has a liquid neon storage tank after the Joule-Thomson valve.

In another embodiment of the present invention, the helium circuit system has a liquid helium storage tank after the Joule-Thomson valve.

In another embodiment of the present invention, the apparatus has a liquid neon storage tank after the Joule-Thomson valve in the neon circuit system, and a liquid helium storage tank after the Joule-Thomson valve in the helium circuit system.

The liquid helium storage tank may be used for cooling an additional device or material such as a cryostat.

Figure 1:
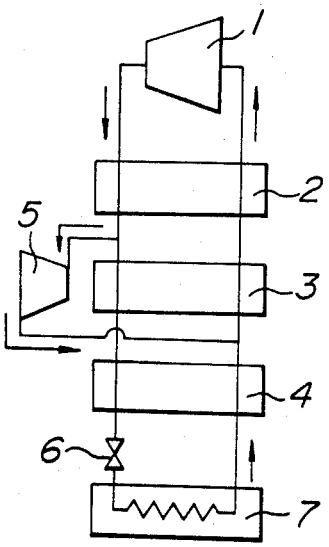
FIG. 1 is a block diagram of a conventional apparatus.

Throughout different views of the drawings, 1 is a compressor, 2, 3 and 4 are heat exchangers, 5 is a turbo type expansion machine, 6 is a Joule-Thomson valve, 7 is a liquefied helium storage tank or a device to be cooled, 11 is a turbo type compressor, 12 is a first neon gas expansion turbine, 13 is a second neon gas expansion turbine, 14 is a turbo type helium gas compressor, 15 and 17 are Joule-Thomson valves, 16 is a helium gas expansion turbine, 18–25 are heat exchangers, 26 is an optional liquid neon storage tank, and 27 is an optional liquid helium storage tank.

DETAILED DESCRIPTION OF THE INVENTION

Comparisons of properties of a turbo type compressor and other type compressors are shown in the following Table 1.

TABLE 1

| | Comparison of Compressors | | | |
|---|---|---|---|---|
| | Type | | | |
| Item | Recipro | Screw | Turbo | Inclined plate |
| Treatable flow rate | ≦1,500 $Nm^3/h$ (1) | 1,400–6,000 $Nm^3/h$ | ≧1,000 $Nm^3/h$ (2) | ≦1,500 $Nm^3/h$ |
| Isothermal efficiency | about 60% | about 40–50% | about 70% or more | about 60% |
| On site system (3) | not applicable | not applicable | applicable | not applicable |
| Heat efficiency of on site system (3) | — | — | about 50% | — |
| Heat efficiency of off site system (4) | about 25% | about 25% | about 25% | about 25% |
| COP of the apparatus (5) | 0.02 (Max) | 0.02 (Max) | 0.025 | 0.02 (Max) |

Notes:

(1) There were large size compressors prior to the appearance of turbo type compressors, which, however, were inferior to turbo type compressors in terms of efficiency, reliability, maintenance, accessibility and repair, so that turbo type compressors have been adopted for large size compressors.

(2) Gaseous helium has so small a molecular weight (4) that it cannot be compressed to a high pressure of, e.g., about 10 atm, in a turbo type compressor at an ambient temperature. Hence, the values described in this column are those obtained by using neon gas instead of helium gas.

(3) An on site system is a system wherein a compressor is directly driven by a power turbine which energy needs not be converted to electric current and exited thermal energy can be effectively utilized, so that it has a good thermal efficiency.

(4) An off site system is a system which uses an electric power obtained by e.g. a so-called power plant. In such a power plant, thermal efficiency is on the order of about 35%. However, considering electric supply loss, motor power loss and mechanical power transmission loss, practical effective thermal efficiency is 25% at the maximum.

(5) COP is an abbreviation of coefficient of performance.

A turbo type compressor has the following characteristic features in addition to the abovementioned characteristic features. Namely, (1) it can use a pneumatic bearing or gas bearing, so that it can eliminate "interfusion of water and oil into the helium line" which was the largest defect of conventional compressors. (2) It is a non-contact support system, so that a long life of mean time between failures of about 50,000 hrs can be expected and high reliability can be attained. (3) It can be constructed integrally with a power turbine and in a cartridge type, because compressor blades at an ambient temperature for the apparatus of 4 KW class for producing liquid helium of temperature of about 4.4° K. have a small diameter of 320 mm at the maximum. Therefore, it can be installed, operated, maintained and accessed easily, and repaired easily by simply exchanging the disabled compressor or integrated power turbine if the compressor or power turbine was so damaged as to cease operating.

DESCRIPTION OF THE PREFERRED EMBODIMENT

Hereinafter, the present invention will be explained in more detail with reference to the attached drawing showing a preferred embodiment which, however, should not be construed by any means as limitations of the present invention.

Figure 2:
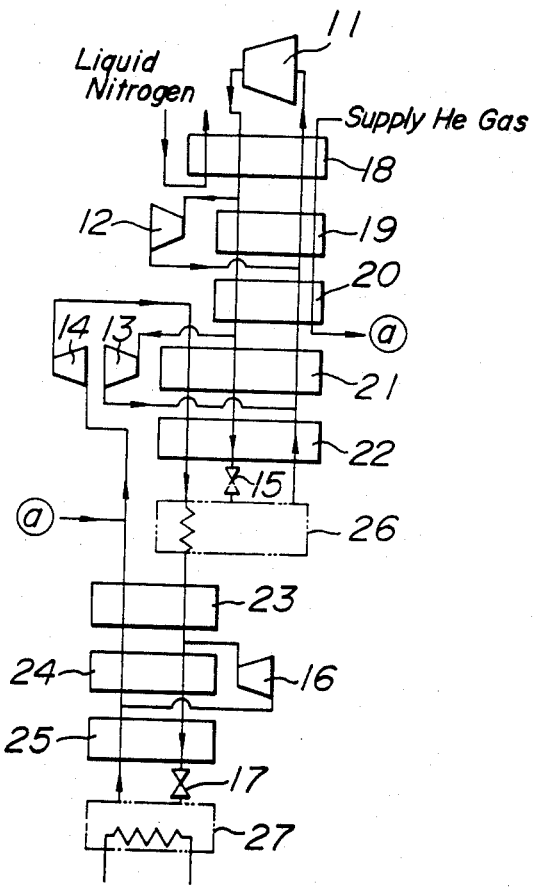
FIG. 2 is a block diagram of an embodiment of the apparatus according to the present invention.

Referring to FIG. 2 the apparatus of the present invention is provided with the neon circuit system for precooling helium gas according to the present invention. The neon circuit system illustrated in FIG. 2 is composed of a turbo type compressor 11, heat exchangers 18, 19, 20, 21 and 22, turbo type expansion machines 12 and 13, and a Joule-Thomson valve 15 with an optional liquid neon storage tank 26.

Neon gas of a temperature of about 300° K. is compressed in the turbo type compressor 11 to a high pressure of about 10–20 atm, and then passed through the heat exchanger 18 to heat exchange with an optionally used liquid nitrogen ($LN_2$) as well as with a low temperature return neon gas consisting of a low temperature neon gas coming from the first neon gas expansion turbine 12 through the heat exchanger 19, a low temperature return neon gas coming from the second neon gas expansion turbine 13 through the heat exchangers 21, 20 and 19, and a low temperature return neon gas coming from the Joule-Thomson valve 15 through the optional liquid neon storage tank 26 and the heat exchangers 22, 21, 20 and 19, whereby its temperature is decreased to about 25°–30° K. The high pressure neon gas stream of decreased temperature from the heat exchanger 18 is divided or distributed. A portion thereof is fed to the first neon gas expansion turbine 12 wherein it performs work and decreases its temperature to form a portion of the low temperature return neon gas through the heat exchanger 19. The remaining portion of the high pressure neon gas stream is passed through the heat exchangers 19 and 20 wherein it is heat exchanged with the low temperature return neon gas coming from the second neon gas expansion turbine 13 through the heat exchanger 21 and coming from the Joule-Thomson valve 15 through the optional liquid neon storage tank 26 and the heat exchangers 22 and 21, thereby to decrease its temperature, and subsequently further divided or distributed at the exit of the heat exchanger 20. A portion thereof is transferred to the second neon gas expansion turbine 13 wherein it performs work and decreases its temperature to form a portion of the low temperature return neon gas through the heat exchanger 21. The remaining portion of the high pressure neon gas is passed through the heat exchangers 21 and 22 wherein it is further decreased in temperature and simultaneously cools helium gas of a high pressure of about 10–20 atm produced by a turbo compressor 14. The temperature-decreased neon gas exited from the heat exchanger 22 is transported to the Joule-Thomson valve 15 wherein it effects an adiabatic free expansion to decrease its temperature and is partly liquefied, which liquefied portion is held or stays in a storage tank 26 at a temperature of about 25°–30° K. to further cool the refrigerated helium gas from the heat exchanger 22. Low temperature neon gas unliquefied or vapourized in the storage tank 26 is passed through the heat exchangers 22, 21, 20, 19 and 18 in this order and thereafter compressed again in the turbo type compressor 11. It heat-exchanges in the heat exchangers 18, 19 and 20 with helium gas to precool the same before supplying it to the helium circuit system. The heat exchangers 21 and 22 and the optional liquid neon storage tank 26 cool the precooled helium gas after it is compressed in the turbo type compressor 14.

In this fashion, the neon circuit system cools the precooled helium gas to a temperature of about 25°–30° K. and absorbs the heat of helium gas generated accompanying the compression thereof. Heat exchangers which can be used in the apparatus of the present invention are, for example, aluminum fin type heat exchangers.

As mentioned above, the heat exchangers 18, 19 and 20 precool helium gas to be supplied in the helium circuit system. The precooled helium gas is denoted by ⓐ, and is introduced into the helium circuit system as shown in the drawing. The liquid nitrogen fed to the heat exchanger 18 cools the neon gas and the helium gas, absorbs the heat of the gases and is evaporated as $N_2$ gas (the liquefying temperature of $N_2$ gas is 77° K.).

In another aspect of the present invention, $LN_2$ is produced in the neon circuit system, if the circuit system has an extremely large flow rate of neon gas therein. In another aspect of the present invention, $LN_2$ passing through the heat exchanger 18 may be omitted, if the circuit system has a sufficiently large flow rate of neon therein to cool the heat exchanger 18 by itself. Therefore, the passage of $LN_2$ through the heat exchanger 18 is optional and is not essential, as shown in dotted lines in the drawing.

The storage tank 26 is used as a heat exchanger for the heat exchange of liquefied neon (LNe) with helium gas, and gives a sufficiently high efficiency even when it is small in size, because efficiency of heat transfer from liquid to gas is superior to efficiency of heat transfer from gas to gas.

The heat exchanger 21 and 22 and liquid neon storage tank 26 are arranged at the highest temperature zone of the helium circuit system, so that heat loss at the high temperature side of the heat exchangers 21 and 22 and the liquid neon storage tank 26 has a direct influence on the coefficient of performance (COP) of the apparatus. Thus, heat efficiency of the heat exchangers 21 and 22 and the liquid neon storage tank 26 is improved by using at the high temperature side thereof the low temperature neon gas of the neon circuit system or the neon-using precooling circuit system, which in turn improves the COP of the apparatus.

Next, the helium circuit system is a system using the helium gas precooled to about 25°–30° K. by the neon circuit system, and is composed of a turbo type compressor 14, heat exchangers 23, 24 and 25, helium gas expansion turbine 16 and a Joule-Thomson valve 17 with an optional liquid helium storage tank 27.

Helium gas precooled to about 25°–30° K. by the neon circuit system is compressed by the turbo type compressor 14 driven by a suitable power source such as an electric motor to a high pressure of about 10–20 atm. The high pressure helium gas is transferred to the heat exchanger 23 through the heat exchangers 21 and 22 and the optional liquid neon storage tank 26 of the neon circuit system, wherein it is heat exchanged with a low temperature return helium gas derived from the helium gas expansion turbine 16 and the Joule-Thomson valve 17 with the optional liquid helium storage tank 27 through the heat exchangers 25 and 24, and subsequently a portion thereof is delivered to the helium gas expansion turbine 16 wherein it performs work and is converted to the abovementioned low temperature return helium gas through the heat exchanger 24. The remainder of the high pressure helium gas is delivered to the heat exchangers 24 and 25 and further cooled therein, and then fed to the Joule-Thomson valve 17 and subjected to an adiabatic free expansion therein to decrease its temperature, and a portion thereof is liquified and held in the liquid helium storage tank 27. The liquefied helium in the storage tank 27 is used to cool a load such as a superconducting magnet or the like, or it is taken out to the exterior for utilization.

The turbo type compressor 14 for compressing the precooled low temperature helium gas used in the helium circuit system is small in size. For example, if the compressor 14 is a 4 KW class for producing liquid He (LHe) of a temperature of about 4.4° K. in the helium circuit system, it has an outer diameter of 130 mm at the maximum and an inlet pressure of 1.2 atm, so that it can be housed easily in a cold box. It is essential that the pressure produced in the compressor 14 is drawn to a negative pressure and the compressor can produce in the helium circuit system LHe of a low temperature of about 2.2° K. or the like temperature which is below a so-called "λ (lambda) point" of LHe at which LHe flows without friction, in order to generate a large critical magnetic field by a super conductive material. For this purpose, conventional systems necessitate separately arranged large vacuum pumps working at an ambient temperature and voluminous heat exchangers for converting He gas of the extremely low temperature of a negative pressure to that of an ambient temperature. These large vacuum pumps and voluminous heat exchangers need not be arranged in the helium circuit system according to the present invention, and can be dispensed with or omitted.

If a vacuum pump for the low temperature helium gas is connected at the exit of the low temperature helium gas compressor 14, a compressor with blades of a diameter of about 180 mm gives the abovementioned essential capability sufficiently for a pressure of about 0.5 atm in the compressor 14. Thus, the vacuum pump can be small and housed in a cold box, and the heat exchangers can be extremely compact because they are merely required to decrease the temperature of helium gas of a much high temperature to about 30°–50° K. As a result, the size of the cold box can be reduced to about half as much as the conventional ones, which can be still further reduced if a small vacuum pump etc. is taken into consideration or adopted in the helium circuit system.

As is apparent from the above explanations, the present invention has many advantages as follows. Namely, (1) By the use of the neon circuit system as a circuit system for precooling and further cooling helium gas, the whole apparatus can be made as a turbine type system of a high reliability, so that a long period of continuous operation with highly improved reliability is achieved and the coefficiency of performance of the apparatus is improved by 25% or more. In addition, because gas bearings can be used at any desired part of the apparatus, the mean time between failures of important machines or devices such as expansion machines, compressors or the like is extensively prolonged to 50,000 hrs or more. (2) Because the turbine type compressors used for compressing neon gas have a good compression efficiency and helium gas is compressed at a sufficiently low temperature of about 25°–30° K. that the compression efficiency is high, the whole apparatus can be operated with high efficiency. As a power source for the turbo type neon compressor, use can be made of a gas turbine engine or the like as well as an electric motor. (3) By turbonizing the helium gas compressor, which has the largest weight among the constitutional elements or parts of conventional apparatus, the compressor can be reduced in size or scaled down. By the separation of neon circuit system from the helium circuit system, the neon circuit system can be operated at high pressure, so that heat exchangers in the neon circuit system can be reduced in size. By making the apparatus small and light, the apparatus can be mounted in ships, aeroplanes, space machines or the like. (4) By enhancing the driving power of the helium compressor, the low pressure side of the helium circuit system can be a negative pressure, so that the temperature for cooling the helium gas can be lowered easily to about 4.2° K. or less. In this circumstance, because the helium circuit system is restricted to a temperature of about 30° K. or less, heat loss therein is small even when relatively small heat exchangers are used.

The apparatus of the present invention has a structure and advantages as described above, so that it can advantageously be used for cooling large size superconducting apparatuses in the fields of high energy physics, nuclear fusion, superconducting electric power supply, MHD electric power generation, superconducting electric power generators, and electric motors to be mounted in ships etc. Therefore, the apparatus of the present invention is eminently useful industrially.

Although the invention has been described with a certain degree of particularity, it is understood that the present disclosure has been made only by way of example and that numerous changes in details of construction and the combination and arrangement of parts may be resorted to without departing from the scope of the invention as hereinafter claimed.

What is claimed is:

1. A helium gas-refrigerating and liquefying apparatus comprising:

a neon gas-refrigerating and liquefying circuit system for pre-cooling helium gas, comprising:

a turbo-type gas compressor for compressing neon gas and delivering the compressed neon gas to a first plurality of interconnected heat exchangers;

at least one turbo-type neon gas expansion machine maintaining a temperature differential across at least one of the heat exchangers of said first plurality;

a first Joule-Thomason valve interconnecting an outlet and an inlet of a last of the heat exchangers of said first plurality; and means for passing helium gas through at least one of the said heat exchangers of said first plurality to pre-cool said helium gas;

a helium gas-refrigerating and liquefying circuit system for further cooling and liquefying said precooled helium gas comprising:

a turbo-type helium gas compressor for compressing said precooled helium gas and delivering the compressed helium gas to a second plurality of interconnected heat exchangers;

at least one helium gas expansion machine maintaining a temperature differential across at least one of the heat exchangers of said second plurality; and a second Joule-Thomson valve interconnecting an outlet and an inlet of a last of the heat exchangers of said second plurality.

2. A helium gas-refrigerating and liquefying apparatus as defined in claim 1, further comprising means for passing said compressed precooled helium gas through at least one of the heat exchangers of said first plurality to further cool said gas.

3. A helium gas-refrigerating and liquefying apparatus as defined in claim 1, wherein the neon gas-refrigerating and liquefying circuit system further comprises a liquid neon storage tank arranged between said first Joule-Thomson valve and said inlet of said last heat exchanger of said first plurality.

4. A helium gas-refrigerating and liquefying apparatus as defined in claim 1, wherein the helium gas-refrigerating and liquefying circuit system further comprises a liquid helium storage tank arranged between said second Joule-Thomson valve and said inlet of said last heat exchanger of said second plurality.

5. A helium gas-refrigerating and liquefying apparatus as defined in claim 1, wherein the neon gas-refrigerating and liquefying circuit system further comprises a liquid neon storage tank arranged between said first Joule-Thomson valve and said inlet of said last heat exchanger of said first plurality, and the helium gas-refrigerating and liquefying circuit system further comprises a liquid helium storage tank arranged between said Joule-Thomson valve and said inlet of said last heat exchanger of said second plurality.

6. A helium gas-refrigerating and liquefying apparatus as defined in claim 1, wherein the neon gas-refrigerating and liquefying circuit system further comprises means for cooling the neon gas in the system by use of liquid nitrogen.

7. A helium gas-refrigerating and liquefying apparatus as defined in claim 1, wherein the neon gas-refrigerating and liquefying circuit system further comprises means for producing liquid nitrogen by heat exchange with an extremely large amount of the neon gas in a heat exchanger of the neon gas circuit system.

* * * * *